United States Patent [19]

Koito et al.

[11] Patent Number: 4,516,586

[45] Date of Patent: May 14, 1985

[54] REAMER FOR PIPE

[75] Inventors: Toshio Koito; Tetsuo Koito; Miyoko Koito, all of Tokyo, Japan

[73] Assignees: Yugen-gaisha Koito-Seisakusho; Yugen-gaisha Koito-Seimitsu; Yugen-gaisha Koito-Denki, all of Tokyo, Japan

[21] Appl. No.: 496,714

[22] Filed: May 20, 1983

[30] Foreign Application Priority Data

Jun. 25, 1982 [JP] Japan ..... 57-94524[U]

[51] Int. Cl.[3] ..... A24F 9/10

[52] U.S. Cl. ..... 131/246

[58] Field of Search ..... 131/246, 329

[56] References Cited

U.S. PATENT DOCUMENTS

| | | | |
|---|---|---|---|
| 569,371 | 10/1896 | Culver | 131/246 |
| 1,851,124 | 3/1932 | Malsburg | 131/246 |
| 2,149,206 | 2/1939 | Brinnow et al. | 131/246 |
| 3,110,316 | 11/1963 | Graff | 131/246 |

*Primary Examiner*—V. Millin

*Attorney, Agent, or Firm*—Jordan and Hamburg

[57] ABSTRACT

A reamer includes two reamer plates overlapping with each other. On the base and tip section of these plates, there is provided an adjustable part and both plates are coupled so as to be opened and closed while centering the adjustable part on the tip section. The adjustable part on the base section has an adjusting screw, an adjusting hole, and a screw rod that passes through the adjusting hole which is situated eccentrically to the adjusting screw. The direction in which the adjusting screw is fastened is coincident with the direction in which the reamer plate is closed.

9 Claims, 8 Drawing Figures

REAMER FOR PIPE

BACKGROUND OF THE INVENTION

The present invention relates to a reamer for a pipe. The thickness of carbon cake formed on the inner wall of a pipe bowl dominates the taste of the smoking tobacco in a pipe. In this connection, various kinds of reamers for scraping off such carbon cake to a desirable thickness have hitherto been proposed. Among these reamers there is one in which the width of the cutting edges for reaming has been adjustable to the size and shape of the inner wall of the bowl. The construction of this prior art reamer is that the two pieces of T-shaped plates overlap each other and are fixed on their upper center part by a screw. In operation, the screw is unfastened, and by sliding the two plates from side to side, the distance between the cutting edges of the plates is adjusted, and then the screw is fastened to secure the position. However, this prior art reamer has disadvantages in that because of fixing the two plates by means of a single, ordinary screw, the plates often become unsteady and move out of place, and as a result, it takes time in order to properly perfect the fixing of the plates.

Accordingly, an object of the present invention is to provide a reamer whose plates can be fixed reliably by a simple operation.

Another object of the present invention is to provide a reamer wherein the distance between the cutting edges of the plates can be adjusted with ease.

A still further object of the present invention is to provide a trustworthy reamer for cutting carbon cake.

The present invention includes two reamer plates having operating parts on their base sections and which overlap each other, thus constituting a T-shape configuration. Cutting edge parts are formed on the angular section located diagonally to both reamer plates. Both reamer plates are coupled to each other so as to be able to open and close in a swinging motion centering the tip section. An adjusting screw is provided on a base section of one of the reamer plates and is freely turnable on the base section of the other reamer plate on which is formed an adjusting hole. A screw rod passes through the adjusting hole and a clamp screw is provided for connecting and coupling the adjusting screw, the screw rod being disposed eccentrically to the adjusting screw. The direction in which the adjusting screw is fastened is coincident with the direction in which the reamer plate is closed.

Other features of the present invention will be understood more clearly with reference to the description of the embodiments as shown in the accompanying drawings.

DESCRIPTION OF THE PREFERRED EMBODIMENTS

Figure 1:
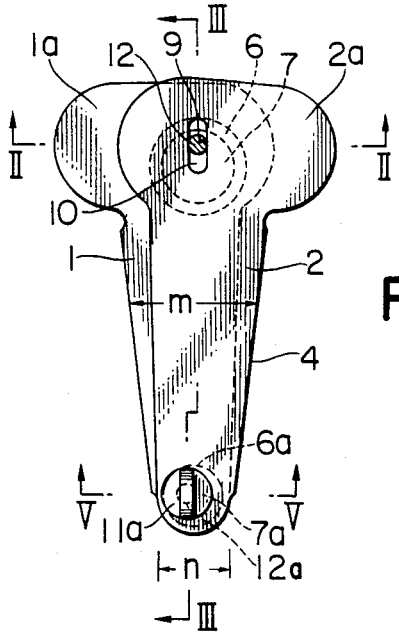
FIG. 1 is a front view of a pipe reamer with the main part of the clamp screw omitted.
Figure 2:
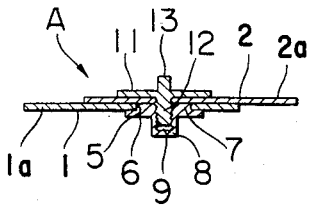
FIG. 2 is a sectional view taken along the line II—II in FIG. 1.
Figure 3:
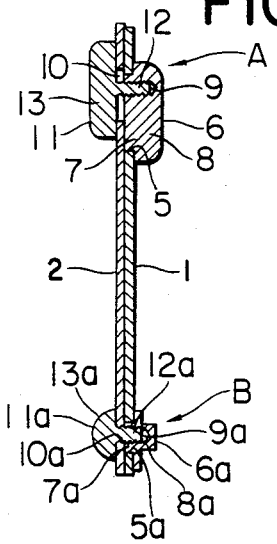
FIG. 3 is a sectional view taken along the line III—III in FIG. 1.
Figure 5:
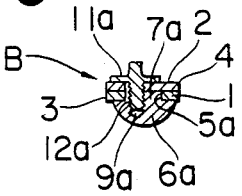
FIG. 5 is a sectional view taken along the line V—V in FIG. 1.

In FIG. 1 through FIG. 3, a reamer includes two reamer plates 1, 2 made of a material such as stainless steel, etc. Both reamer plates overlap each other. On the base and tip sections of reamer plates 1, 2 there are formed respectively operating parts 1*a*, 2*a* projecting outwardly. The reamers are nearly T-shaped. On an angular section situated diagonally to both reamer plates 1, 2, there are formed cutting edges 3, 4 (FIG. 1, FIG. 5).

The base and tip sections of reamer plates 1, 2 are provided with an adjustable part A and an adjustable part B. The reamer plates can open and close in a swinging motion centering on either one of the adjustable parts A (FIG. 2) or B (FIG. 5). This open/close action adjusts the distance m between the cutting edges 3, 4.

First, a description is set forth of the adjustable part A. On the base section of one reamer plate there is formed a mounting hole 5 as shown in FIG. 1 thru FIG. 4, and in this mounting hole there is disposed an axial part 7 of an adjusting screw 6 which extends outside of the reamer plate and is freely turnable. The adjusting screw 6 is provided with a protuberance 8.

The upper end of axial part 7 is in the same plane as the internal surface of plate 1 as shown in FIG. 2. Axial part 7 is provided with a screw hole 9 extending along an axial direction from the upper end, and the screw hole is situated at an eccentric position relative to the axial part 7 as shown in FIG. 3. On the other reamer plate 2, there is formed a longitudinal adjusting hole 10 facing the axial part 7 as shown in FIG. 1 thru FIG. 3. A screw rod 12 of clamp screw 11, which is disposed against the outer surface of plate 2, passes through the adjusting hole 10 and is screwed into the screw hole 9 of adjusting screw 6. Screw rod 12 can move within the adjusting hole 10. Clamp screw 11 is provided with a protuberance 13.

Next, an explanation is set forth as to how reamer plates 1,2, adjusting screw 6 and clamp screw 11 are mutually related.

Figure 4:
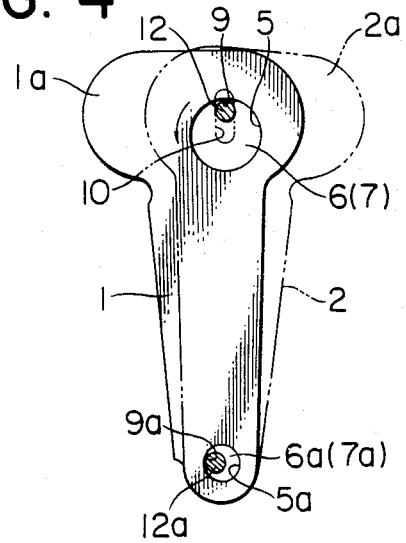
FIG. 4 is a front view showing the relationship of the reamer plate and the adjusting screw.

By turning adjusting screw 6, the screw rod 12 of clamp screw 11, being screwed into screw hole 9, turns within adjusting hole 10. Then, as a result of this movement, screw rod 12 pushes the inner peripheral edge of adjusting hole 10 outwardly. Consequently, the operating part 2*a* of reamer plate moves, thus providing for closing and opening of the reamer plates 1,2. Adjusting screw 6 reinforces the coupling with clamp screw 11 by rotation in the fastening direction which is the direction of the arrow in FIG. 4. For this reason, even if an external force is exerted upon the operating part 2*a* from outwardly to inwardly when reamer plates 1,2 are located at a position as indicated in FIG. 4, this external force acts in the direction in which clamp screw 11 is tightened, through screw rod 12, and therefore, the operating part 2*a* is hard to swing inwardly. By strongly fastening clamp screw 11, moreover, adjusting screw 6 is then fixed, and operating parts 1*a*, 2*a* are also held between both clamp screw 11 and adjusting screw 6 to be fixed in place.

In FIG. 1 and FIG. 3 thru FIG. 5, the composition of adjustable part B is substantially the same as adjustable part A, and its corresponding components have a suffix of "a" added to the numerals showing the respective components of adjustable part A.

Mounting hole 5*a*, adjusting screw 6*a*, axial part 7*a* and clamp screw 11*a* are made smaller than the mounting hole 5, adjusting screw 6, axial part 7 and clamp screw 11 respectively. Adjusting hole 10*a* is made circular. Next, a description is set forth regarding adjusting the distance m between the cutting edges 3,4 of the reamer plates using the adjustable parts A and B.

The reamer is usually used when reamer plates 1,2 are at such positions as shown in FIG. 1 and FIG. 4, in other words, when the screw hole 9 of adjusting screw 6 is at a neutral position. If the bowl of a pipe has a large inside diameter, and if it is required to increase the distance m between the cutting edges 3,4, the operation is as follows.

Figure 6:
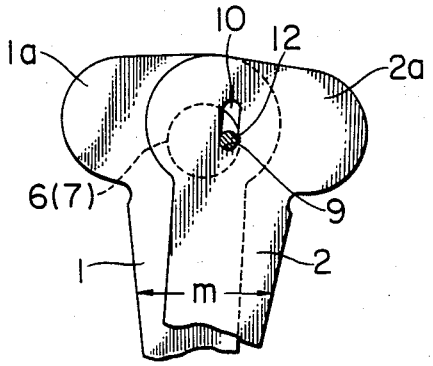
FIG. 6 is a partial front view showing a state in which the distance between the cutting edges is maximized.

The clamp screw 11 is unfastened a little, the adjusting screw 6 is turned in a direction contrary to that as indicated by the arrow shown in FIG. 4. Then, screw rod 12 is moved clockwise and reamer plate 2 thereby pivots clockwise as shown in broken lines in FIG. 4, centering adjustable part B and moving against the lower end of adjusting hole 10 as shown in FIG. 6. Its travel is stopped when the screw rod 12 has traveled nearly 90° to the position as indicated in FIG. 6. Thus, when screw hole 9 reaches a position as shown in FIG. 6 by turning adjusting screw 6 approximately 90°, operating parts 1*a*,2*a* are open at the maximum, and the distance m between the cutting edges is the largest.

Figure 7:
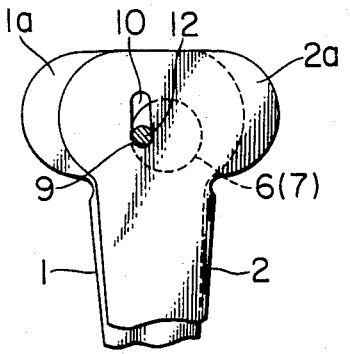
FIG. 7 is a partial front view showing a state in which the distance between the cutting edges is minimized.

To reduce the distance m between the cutting edges, the adjusting screw 6 is turned in the direction indicated by the arrow in FIG. 4, and the operating part 2*a* swings counterclockwise centering the adjustable part B. Consequently, the operating parts 1*a*, 2*a* then gradually close, and as they are turned nearly 90°, screw hole 9 and screw rod 12 reach a position as shown in FIG. 7. As the screw rod 12 abuts against the lower end of adjusting hole 10 at this time, the adjusting screw 6 can no longer turn. When screw hole 9 is situated at the positon as indicated in FIG. 7, the operating parts 1*a*, 2*a* are closed the most, thus the distance m between the cutting edges is the smallest.

Thus, by rotating adjusting screw 6 in an appropriate direction, reamer plates 1,2 swing while centering adjustable part B, thus achieving adjustment of the distance m between the cutting edges. Since adjusting screw 6 works in a fastening direction even when the reamer plates 1,2 are at such positions as shown in FIG. 1 and FIG. 4 or when, during application, operating parts 1*a*,2*a* are caused to close upon being subjected to a strong external force, the operating parts will never be closed by accident. Therefore, no change will be made to the distance m between the cutting edges. For this reason, it is not necessary to keep clamp screw 11 fastened forcibly. Because the screw rod 12 eccentrically coupled with clamp screw 11 prevents the operating part 2*a* from traveling when adjusting screw 6 is situated at a position as indicated in FIG. 6 and FIG. 7, the operating parts 1*a*, 2*a* will never be caused to open too wide nor to close accidentally. Therefore, it is not necessary to keep clamp screw 11 fastened with a strong force. In operating adjusting screw 6, accordingly, it is not required to handle the clamp screw 11 every time, and therefore the operation for adjustment has been rendered relatively simple.

Figure 8:
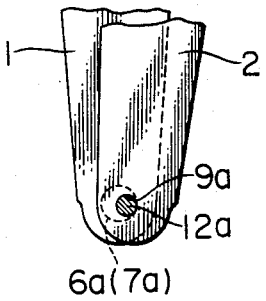
FIG. 8 is a partial front view showing a state wherein the tip section of the reamer plate is widened.

To widen the width n (FIG. 1) of the tip sections for reamer plates 1,2 in accordance with the form of a pipe bowl, adjusting screw 6*a* is made to turn in the direction of the arrow in FIG. 4 after unfastening clamp screw 11*a* a little. Then, as screw rod 12*a* travels in the same direction, reamer plate 2 swings counterclockwise, centering the adjustable part A as shown in FIG. 4, and the tip section of the reamer plate 2 moves to the right side as shown in FIG. 8. Consequently, the width n at the tip sections of reamer plates 1,2 is thus adjusted to become wider.

Screw hole 9 or 9*a* and the screw rod 12 or 12*a* may be relatively reversed, and the screw hole 9 or 9*a* may be provided on the side of the clamp screw 11 or 11*a* and the screw rod 12 or 12*a* may be installed projecting at an eccentric position on the side of adjusting screw 6 or 6*a*.

We claim:

1. A pipe reamer comprising a pair of reamer plates, each of said plates having a pair of end sections, pivotal means at one end section of each of said blades for pivotably mounting said pair of plates for pivotal movement in an increasing angular direction and in a decreasing angular direction, the other end section of one of said plates having a circular mounting opening, an adjusting member having a circular part rotatably disposed in said mounting opening, said adjusting member having a first part eccentrically disposed relative to said circular part, the other end section of said other plate having an adjusting hole, a clamp member justaposed to said other plate and having a second part passing into said adjusting hole, thread means on said first and second parts threadably engaging said first and second parts, said adjusting member being rotatable in said mounting opening to eccentrically displace said first part so that the threadedly engaged second part is concurrently displaced, whereby the displaced second part engages said adjusting hole to pivot said other plate relative to said first plate, said thread means being constructed such that application of an external force tending to pivot said two plates in said decreasing angular direction tightens said thread means such that said adjusting member and said clamp member increasingly wedge said two plates therebetween to thereby resist pivoting of said two plates in said decreasing angular direction.

2. A pipe reamer according to claim 1, wherein said adjusting member has a first engaging section engageable with one side of said one plate, said clamp member having a second engaging section engageable with one side of said other plate, said first and second engaging sections being disposed opposite to one another to wedge said two plates therebetween as said thread means is tightened.

3. A pipe reamer according to claim 1, wherein said adjusting hole in said other plate is an elongated slot, said second part being displaced along said slot upon rotation of said adjusting member.

4. A pipe reamer according to claim 1, wherein said one end section of each of said plates has a generally T-shaped configuration.

5. A pipe reamer according to claim 1, wherein each of said pair of plates has cutting edges.

6. A pipe reamer according to claim 1, wherein said pivotal means comprises an eccentric adjusting part for adjusting the relative pivotal position of said one end section of said pair of plates.

7. A pipe reamer according to claim 1, wherein said pivotal means comprises a second adjusting member having a second circular part, a first one of said plates having a second circular mounting opening, said second circular part of said second adjusting member being rotatably disposed in said second circular mounting opening, said second adjusting member having a first thread part eccentrically disposed relative to said second circular part, the second one of said plates having a second adjusting hole, a second clamp member juxtaposed to said second one of said plates and having a second thread part passing through said second adjusting hole, second thread means on said first and second thread parts to threadably engage said first and second thread parts, said second adjusting member being rotatable in said second mounting opening to eccentrically displace said first thread part so that the threadedly engaged second thread part is concurrently displaced, whereby the displaced second thread part engages said second adjusting hole to pivot the second one of said plates relative to the first one of said plates, said second thread means being constructed such that application of an external force tending to pivot said two plates in a decreasing angular direction tightens said second thread means such that said second adjusting member and said second clamp member increasingly wedge said two plates therebetween to thereby resist pivoting of said to plates in the decreasing angular direction.

8. A pipe reamer according to claim 7, wherein said second adjusting hole has a circular configuration.

9. A pipe reamer comprising a pair of reamer plates, each of said plates having a tip section and a base section, pivotal means pivotably mounting said pair of blades at said tip sections for pivotal movement in an increasing angular direction and in a decreasing angular direction, the base section of one of said plates having a circular mounting opening, an adjusting member having a circular part rotatably disposed in said mounting opening, said adjusting member having a first part eccentrically disposed relative to said circular part, said other plate having an adjusting hole, a clamp member juxtaposed to said other plate and having a second part passing into said adjusting hole, thread means on said first and second parts threadably engaging said first and second parts, said adjusting member being rotatable in said mounting opening to eccentrically displace said first part so that the threadedly engaged second part is concurrently displaced, whereby the displaced second part engages said adjusting hole to pivot said other plate relative to said first plate, said thread means being constructed such that application of an external force tending to pivot said two plates in said decreasing angular direction tightens said thread means such that said adjusting member and said clamp member increasingly wedge said two plates therebetween to thereby resist pivoting of said two plates in said decreasing angular direction.

* * * * *